US008857014B2

(12) United States Patent
Brunnmayr

(10) Patent No.: US 8,857,014 B2
(45) Date of Patent: Oct. 14, 2014

(54) DAMPING DEVICE FOR FURNITURE PARTS

(71) Applicant: Julius Blum GmbH, Hochst (AT)

(72) Inventor: Harald Brunnmayr, Horbranz (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/759,318

(22) Filed: Feb. 5, 2013

(65) Prior Publication Data

US 2013/0145580 A1 Jun. 13, 2013

Related U.S. Application Data

(63) Continuation of application No. PCT/AT2011/000284, filed on Jun. 29, 2011.

(30) Foreign Application Priority Data

Aug. 23, 2010 (AT) ..... A 1403/2010

(51) Int. Cl.
*E05F 5/02* (2006.01)
*E05F 5/00* (2006.01)

(52) U.S. Cl.
CPC ..... *E05F 5/006* (2013.01); *E05Y 2201/264* (2013.01); *E05Y 2600/10* (2013.01); *E05Y 2201/21* (2013.01); *E05Y 2201/412* (2013.01); *E05Y 2900/20* (2013.01); *E05Y 2201/254* (2013.01); *E05Y 2201/256* (2013.01); *E05F 5/02* (2013.01)
USPC ..... 16/82; 16/83; 16/319

(58) Field of Classification Search
CPC ..... E05F 5/02; E05F 5/006; E05F 5/00; E05F 5/04; E05Y 2201/264; E05Y 2201/412; E05Y 2201/254; E05Y 2201/256
USPC ..... 16/50, 54, 319, 352, 321, 327, 82, 83, 16/84, 85
See application file for complete search history.

(56) References Cited

U.S. PATENT DOCUMENTS 4,309,027 A * 1/1982 Molders et al. ..... 267/124
4,987,640 A * 1/1991 Lin ..... 16/327

(Continued)

FOREIGN PATENT DOCUMENTS

AT 005 479 7/2002
AT 506 643 10/2009

(Continued)

OTHER PUBLICATIONS

International Search Report issued Oct. 7, 2011 in International (PCT) Application No. PCT/AT2011/000284.

(Continued)

*Primary Examiner* — Jeffrey O Brien
(74) *Attorney, Agent, or Firm* — Wenderoth, Lind & Ponack, L.L.P.

(57) ABSTRACT

A damping device for damping a motion of a movably mounted furniture part or of a movably mounted furniture fitting component of a furniture fitting includes a piston arranged in a fluid chamber. A damping effect is caused by a relative motion between the fluid chamber and the piston and the piston assumes a pressed-in end position relative to the fluid chamber at the end of the damping stroke. The damping device has a locking device which has a locking element that can be operated manually or by means of a tool in order to deactivate the damping effect. The relative position between the fluid chamber and the piston can be releasably locked in the pressed-in end position by the locking element of the locking device.

20 Claims, 6 Drawing Sheets

(56) References Cited

U.S. PATENT DOCUMENTS

| | | | | |
|---|---|---|---|---|
| 5,158,268 | A * | 10/1992 | Schnitzius et al. | 267/64.12 |
| 5,392,493 | A * | 2/1995 | Youngdale | 16/237 |
| 5,592,780 | A * | 1/1997 | Checkovich | 49/386 |
| 5,727,286 | A * | 3/1998 | Shen | 16/49 |
| 7,065,833 | B2 * | 6/2006 | Kropf | 16/286 |
| 7,134,168 | B1 * | 11/2006 | Qing | 16/80 |
| 7,966,696 | B2 * | 6/2011 | Krammer | 16/286 |
| 8,307,498 | B2 | 11/2012 | Krammer | |
| 2003/0126716 | A1 * | 7/2003 | Lin | 16/66 |
| 2008/0168620 | A1 | 7/2008 | Hammerle | |
| 2009/0119873 | A1 * | 5/2009 | Bassi | 16/84 |
| 2009/0119876 | A1 * | 5/2009 | Pecar et al. | 16/293 |
| 2009/0271946 | A1 * | 11/2009 | Lam et al. | 16/84 |
| 2009/0313789 | A1 * | 12/2009 | Lautenschlager | 16/343 |
| 2010/0212109 | A1 * | 8/2010 | Kim | 16/85 |
| 2011/0005032 | A1 | 1/2011 | Domenig et al. | |
| 2011/0019946 | A1 | 1/2011 | Krammer | |
| 2011/0067964 | A1 | 3/2011 | Krammer et al. | |
| 2011/0225768 | A1 | 9/2011 | Haemmerle | |

FOREIGN PATENT DOCUMENTS

| | | |
|---|---|---|
| CN | 101253302 | 8/2008 |
| CN | 201486335 | 5/2010 |
| DE | 102008017770 | 10/2009 |
| EP | 1760353 | 2/2008 |
| WO | 2007/009899 | 1/2007 |
| WO | 2009/094272 | 7/2009 |
| WO | WO2009/124332 | * 10/2009 |
| WO | 2009/140706 | 11/2009 |
| WO | 2010/075595 | 7/2010 |

OTHER PUBLICATIONS

Austrian Patent Office Search Report completed Feb. 15, 2011 in Austrian Patent Application A 1403/2010.

* cited by examiner

DAMPING DEVICE FOR FURNITURE PARTS

BACKGROUND OF THE INVENTION (1) Field of the Invention

The present invention relates to hinges for furniture or the like which including a damping mechanism for damping a movement of a movable furniture part on a piece of furniture.

(2) Description of Related Art

A damping device of the general kind set forth is known for example from WO 2009/140706 A1 to the present applicant, wherein the damping function of the damping device can be deactivated when not in use by way of a switch member to be displaced manually. In that document in the state of the art, in accordance with a variant, the cylinder of the linear damper is arrested by way of the switch member so that the piston can perform a relative movement with respect to the stationary cylinder in the damping stroke, whereby a damping action is also generated. To deactivate the damping function, the switch member is displaced, whereby the cylinder is unlocked. If now the damper is acted upon by force the cylinder will move within the damper housing, but in that case also no damping action is generated in the absence of the relative movement between cylinder and piston. A disadvantage in that case is that the structural space occupied by the damper has to be of relatively large size because of the displaceable cylinder.

BRIEF SUMMARY OF THE INVENTION

Therefore the object of the present invention is to provide a damping device of the general kind set forth in the opening part of this specification, avoiding the above-mentioned disadvantage.

The present invention concerns a damping device for damping a movement of a movably mounted furniture part or a movably mounted furniture fitment component of a furniture fitment, comprising a piston arranged in a fluid chamber, wherein a damping action is produced by a relative movement between the fluid chamber and the piston and wherein the piston assumes a pressed-in end position at the end of the damping stroke relative to the fluid chamber and wherein the damping device for deactivation of the damping action has a locking device having an arresting element which is to be actuated manually or with the aid of a tool.

In addition the invention relates to a furniture hinge comprising a damping device for damping a closing movement and/or an opening movement of the furniture hinge.

According to the invention therefore it is provided that the relative position between the fluid chamber and the piston can be releasably arrested in the pressed-in end position by the arresting element of the locking device—that is to be actuated manually and/or with a tool.

In that way it is therefore possible for the damping device to be releasably arrested in the condition of being completely moved in (that is to say when the piston is in or close to the end region of the fluid chamber), in which case the deactivated or compressed damping device can assume a very compact and space-saving position. An advantage here is that the deactivated damping device can remain in its mounting position, wherein a movable furniture part or a movably mounted furniture fitment component cannot act on the retracted damper.

The proposed damping device can be used in particular in connection with furniture hinges which have a hinge cup. The hinge cup can be sunk in known manner in a—preferably circular—standard bore in an article of furniture. In that case the damping device can be arranged in the mounting position within the cavity in the hinge cup, wherein the damping device can be acted upon from a predetermined relative position of the furniture hinge, by a hinge lever, which can move into the hinge cup, of the furniture hinge. By virtue of its compact deactivation position the damping device can remain in the hinge cup and can also not be acted upon by the hinge lever in that deactivated operative position. The closing movement and/or the opening movement of the furniture hinge therefore take place in undamped fashion. The damping function can be activated again by displacement of the arresting element, by the arresting action on the piston which is moved completely into the fluid chamber being released again. The damping device can then be moved again back into a readiness position provided for the next damping stroke, for example by means of a return spring.

In an embodiment of the invention it can be provided that the piston is arranged stationarily in the mounting position and the fluid chamber is mounted displaceably in the damping stroke relative to the stationary piston. That structure has the advantage that a housing accommodating the fluid chamber can also be used as a slider for applying force. It will be appreciated that, as a mechanical reversal, it is also possible for the fluid chamber to be arranged stationarily in the mounting position and for the piston to be mounted displaceably in the damping stroke relative to the stationary fluid chamber.

In a preferred embodiment of the invention it can be provided that the arresting element is in the form of a linearly displaceable switch having at least two switch positions, wherein the damping action of the damping device is activated in a first switch position and the damping action of the damping device is deactivated in a second switch position. In this connection it may be advantageous if the direction of the movement between the first switch position and the second switch position of the switch extends transversely relative to the direction of the damping stroke, preferably substantially at a right angle. In that way the switch can be displaced transversely relative to the longitudinal direction of the piston rod without the movement of the switch leading to a relative movement between cylinder and piston. If the damping device is fitted in a hinge cup of a furniture hinge the switch can then be displaced without the damping device being able to move out of the mounting position by virtue of the displacement of the switch. A further advantage is the short switching movement of the switch, that is required for activation and deactivation of the damping function.

The fluid chamber can be formed by an internal cavity in a damper housing or the internal cavity in a cylinder. Air, gas or a liquid can be used as the damping fluid. It is also possible to generate a damping action by solid-state friction.

For resetting the damping device to a readiness position for the next damping stroke it may be advantageous if there is provided a return mechanism—preferably having at least one return spring—, by which the piston—also after the arresting action is released—is movable again into an extended end position relative to the fluid chamber.

The furniture hinge according to the invention is characterized by a damping device of the kind described.

In a possible development it can be provided that the furniture hinge has a carcass-side fitting member and a hinge cup hingedly connected thereto for fixing to furniture parts, wherein the damping device in the mounting position is arranged substantially completely within the hinge cup, or wherein the damping device—with the fitting member and the hinge cup already hingedly connected together—can be fitted from above into the hinge cup and can be arranged within the hinge cup, wherein the damping device can be connected to the hinge cup by way of cooperating securing means in said mounting position.

BRIEF DESCRIPTION OF THE DRAWINGS

Further details and advantages of the present invention will be described below with reference to the drawings in which.

DETAILED DESCRIPTION OF THE INVENTION

Figure 1:
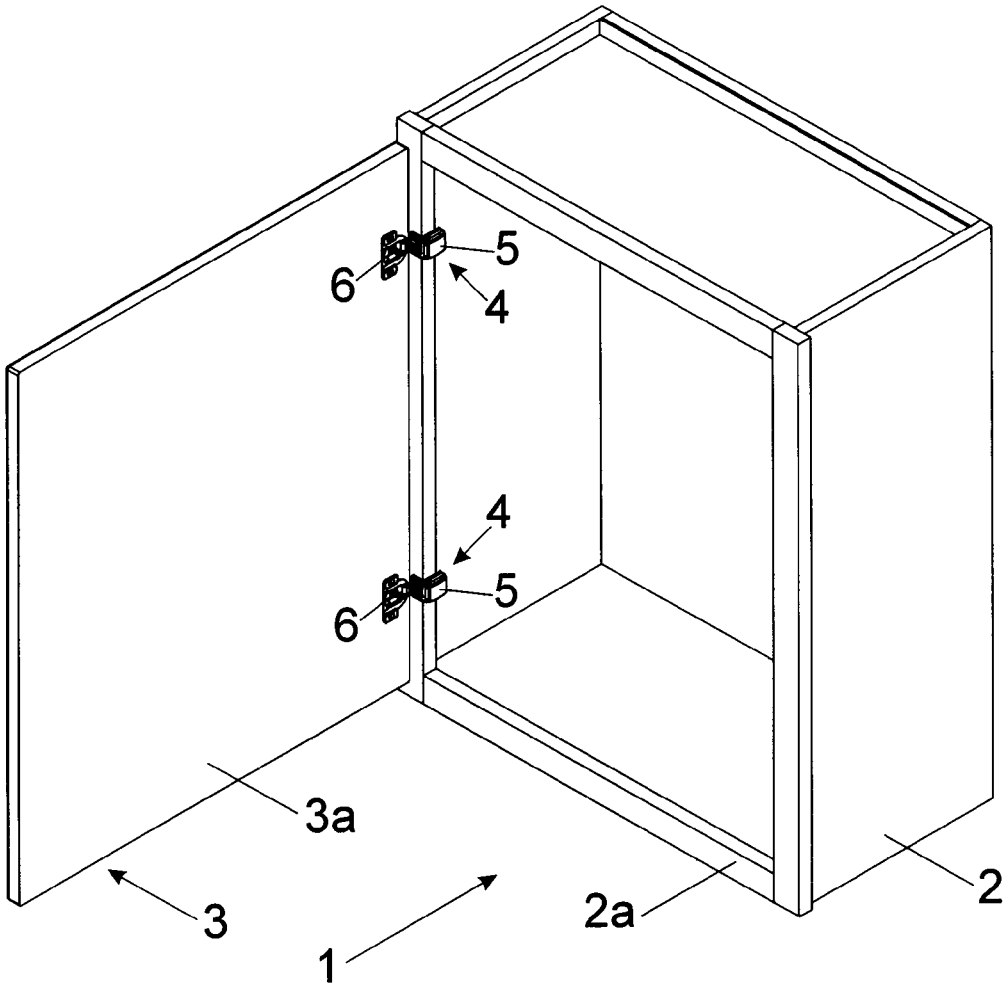
FIG. 1 shows a perspective view of an article of furniture having a door mounted pivotably by way of furniture hinges relative to a furniture carcass.

FIG. 1 shows a perspective view of an article of furniture 1, wherein a movable furniture part 3 in the form of a door 3*a* is mounted pivotably relative to a furniture carcass 2 by way of two or more furniture hinges 4. In known manner the furniture hinges 4 have a fitting member 5 to be fixed to a frame 2*a* and a hinge cup 6 connected pivotably to the fitting member 5. Mounted in the internal cavity in the hinge cup 6 is a respective damping device (not visible here), by which a closing movement of the furniture hinge 4 towards the fully closed end position can be damped. Depending on the respective size and weight of the movable furniture part 3, the damping capacity of the damping devices may not be suitably adapted, that is to say if the damping capacity is excessively strong the movable furniture part 3 can either move into the completely closed position too slowly, or not at all. For that reason the damping action of the damping devices can be completely deactivated by way of a locking device. In that case it may be for example desirable for the damping action of a first furniture hinge 4 to be completely deactivated while a second furniture hinge 4 provides an active damping action which permits a desired damped closing movement of the movable furniture part 3 to the completely closed position.

Figure 2A:
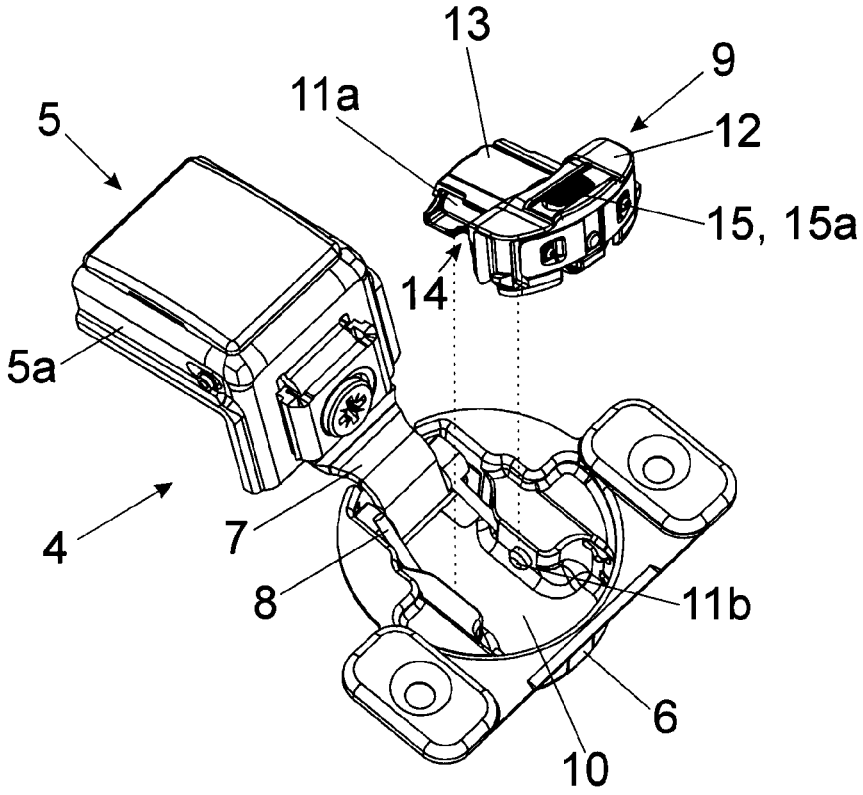
FIGS. 2*a* and 2*b* show perspective views of a furniture hinge with a damping device which is to be arranged in the hinge cup and a damping device which is arranged in the hinge cup.

FIG. 2*a* shows a perspective view of a furniture hinge 4, wherein the hinge cup 6 is connected by way of at least one hinge lever 7 pivotably to the fitting member 5 which is in the form of a hinge arm 5*a*. The furniture hinge 4 can be moved into the completely closed position and/or the completely open position by way of a spring device 8. To damp that spring-assisted movement into the end position or positions, there is provided a damping device 9 having a housing 12 and a slider 13 movable relative thereto. The damping device 9 is either already pre-fitted into the internal cavity 10 in the hinge cup 6, as from the factory, or alternatively—with the fitting member 5 and the hinge cup 6 fitted in place—it can be inserted from above into the hinge cup 6 in a retrofitting procedure and can be arranged within the hinge cup 6, in which case the damping device 9 can be releasably connected together in the mounting position by way of cooperating securing means 11*a*, 11*b*. In the illustrated embodiment the damping device 9 has first securing means 11*a* in the form of a guide groove which can be releasably connected to securing means 11*b* arranged on the hinge cup 6, in the form of a securing projection. The damping device 9 has an introduction opening 14, through which the securing projection 11*b* can be arranged in the guide groove 11*a*. For deactivation of the damping function the damping device 9 has a locking device 15 with a displaceable arresting element 15*a* in the form of a switch, by which the slider 13 can be releasably arrested in the completely pressed-in position.

Figure 2B:
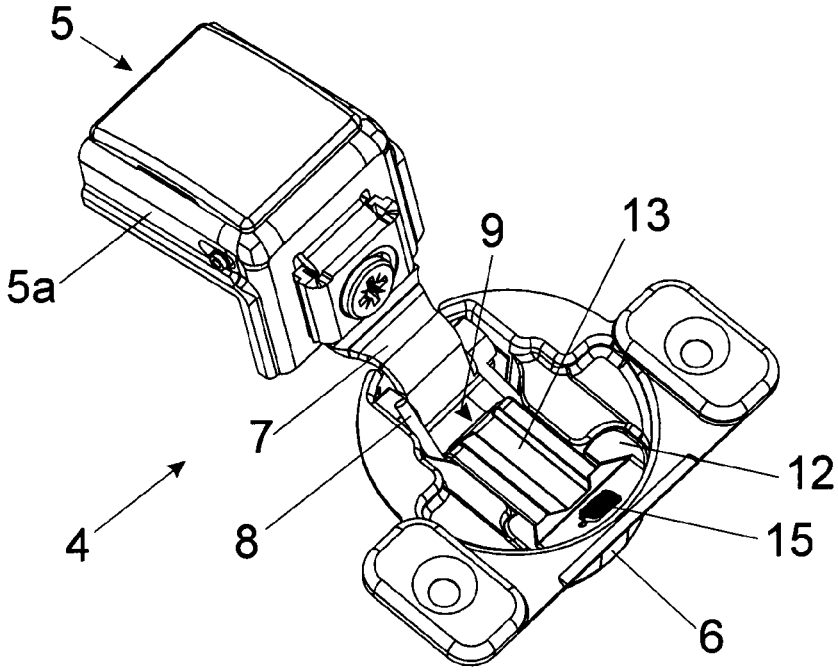

FIG. 2*b* shows a perspective view of the furniture hinge 4 with the damping device 9 in the mounting position. The damping device 9 is arranged completely in the internal cavity 10 in the hinge cup 6. In the closing movement of the furniture hinge 4 the hinge lever 7 abuts the slider 13, whereby the damping operation is initiated. In the course of the further closing movement the slider 13 can be pressed relative to the housing 12 into a complete end position, wherein that end position can be releasably arrested by the locking device 15. The slider 13 can no longer be returned in the arresting position, in which case therefore the damping action is deactivated.

Figure 3A:
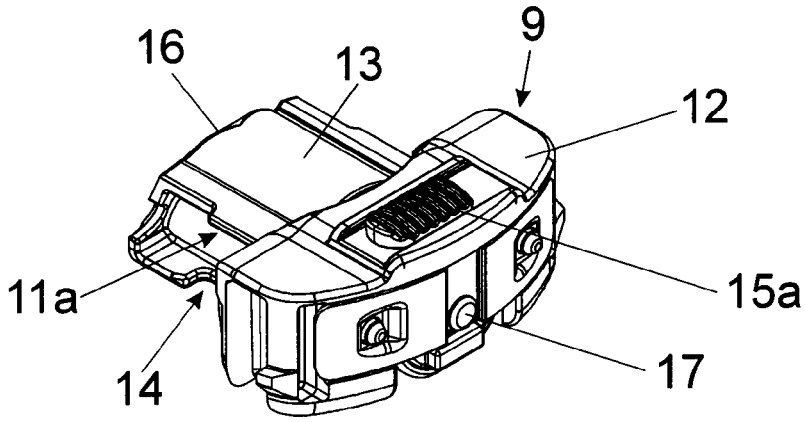
FIGS. 3*a*-3*c* show the damping device in a perspective view and enlarged views of the arresting element in two different switch positions.
Figure 3B:
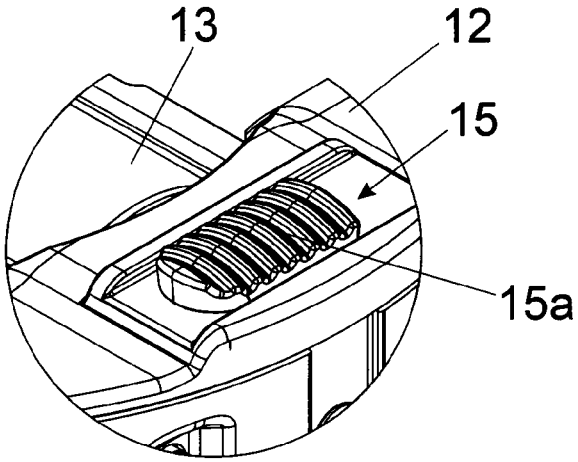
Figure 3C:
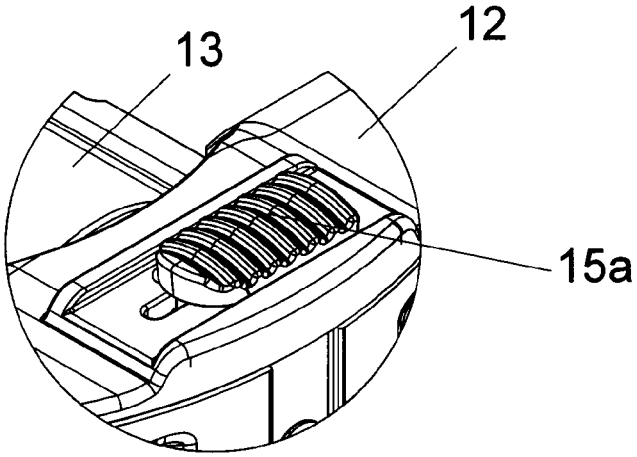

FIG. 3*a* shows a perspective view of the damping device 9. It has a housing 12 and a slider 13 displaceable relative thereto. The damping device 9 is in the form of a linear damper and includes a piston rod 17 connected to the housing 12. In this embodiment therefore it is provided that the piston rod 17 (and therewith a piston connected to the piston rod 17) is arranged stationarily in the mounting position while a fluid chamber provided in the slider 13 moves relative to that stationary piston rod 17. The slider 13 is in the form of a sliding wedge and has an inclined abutment surface 16 which can be acted upon by the hinge lever 7 (FIG. 2*b*) as from a predetermined relative position of the furniture hinge 4. FIG. 3*b* shows an enlarged detail view of the arresting element 15*a* which in the illustrated embodiment is in the form of a switch with at least two switch positions. In a first switch position (FIG. 3*b*) the damping action of the damping device 9 is activated while in a second switch position (FIG. 3*c*) the damping action of the damping device 9 is deactivated.

Figure 4A:
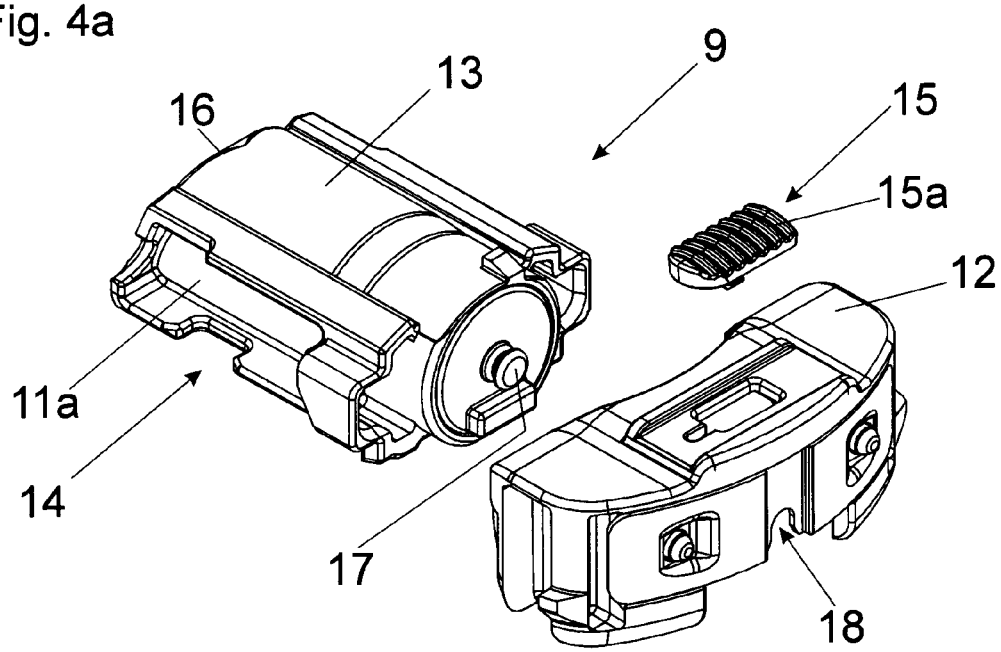
FIGS. 4*a*-4*c* show the damping device in an exploded view, an enlarged detail view of the slider and the arresting element in a perspective view from below.

FIG. 4*a* shows an exploded view of the damping device 9. Provided in the interior of the slider 13 is at least one fluid chamber in which at least one piston (not visible here) with a piston rod 17 is mounted displaceably. It is possible clearly to see the securing means 11*a* in the form of guide grooves at both sides, by which the slider 13 is displaceable in the damping stroke relative to the securing projections 11*b* of the hinge cup 6. The securing projection 11*b* can be arranged in the guide groove 11*a* through the introduction opening 14. The housing 12 has a mounting 18, to which the piston rod 17 is to be secured. Arranged on the slider 13 is a first fixing element 19 which can be fixed in the pressed-in end position of the slider 13 relative to a second fixing element 20 arranged on the switch 15*a*.

Figure 4B:
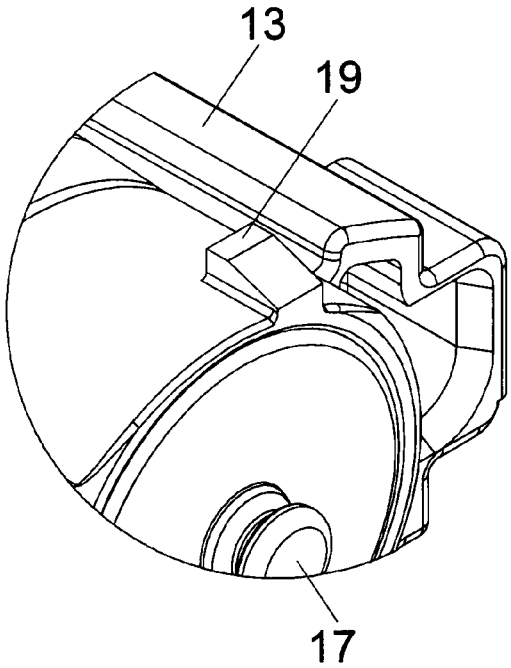
Figure 4C:
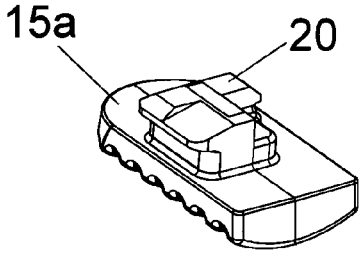

FIG. 4*b* shows an enlarged detail view of the slider 13, on which there is provided a first fixing element 19 in the form of a resilient tongue. FIG. 4*c* shows a perspective view from below of the arresting element 15*a* in the form of a switch. Arranged at the underside of the arresting element 15*a* is a second substantially rigid fixing element 20, by which the first fixing element 19 of the slider 13 can be fixed in the completely pressed-in end position of the slider 13.

Figure 5A:
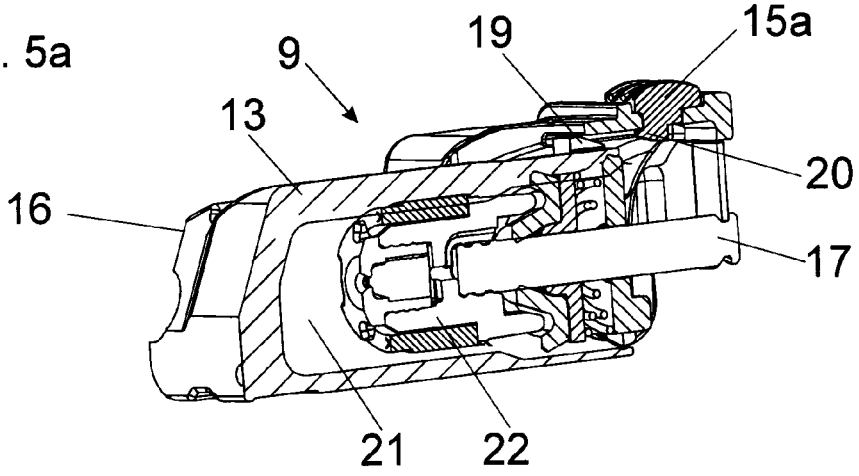
FIGS. 5*a*-5*c* show various longitudinal sections of the damping device, showing time successions of the arresting process for deactivation of the damping function.
Figure 5B:
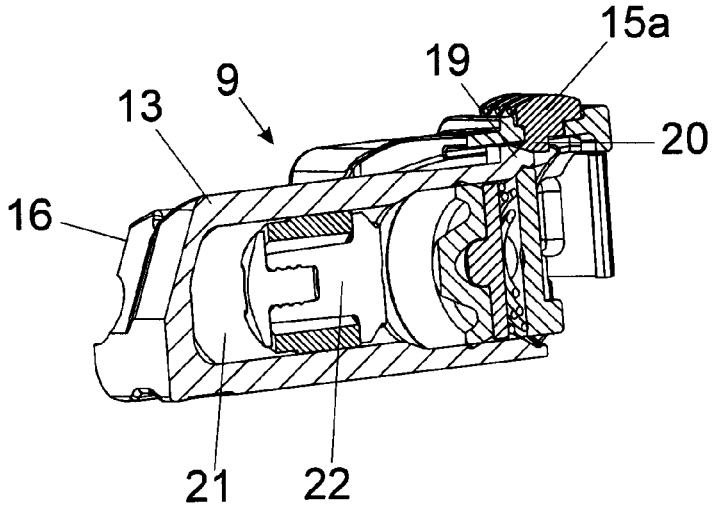
Figure 5C:
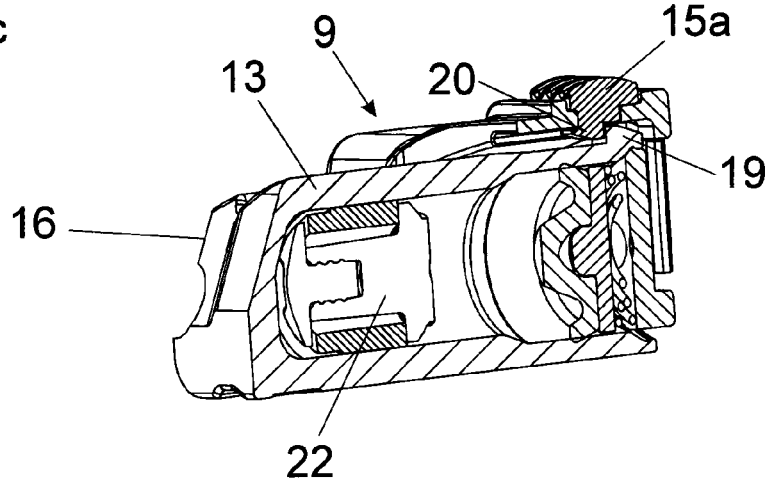

FIGS. 5*a*-5*c* show time successions of the arresting effect for deactivation of the damping action in various cross-sections. It is possible to see in FIG. 5*a* the slider 13 in which there is provided a fluid chamber 21 in which there is mounted a piston 22 having a piston rod 17, which in the illustrated embodiment is arranged stationarily. In the closing movement of the furniture hinge 4 the hinge lever 7 (FIG. 2*b*) impinges on the inclined abutment surface 16 of the slider 13, whereupon the slider 13 is displaceable relative to the stationary piston 22. The damping device 9 can also be deactivated with the slider 13 extended, by firstly the arresting element 15*a* which is in the form of the switch being moved into the corresponding deactivation position (FIG. 5*a*). It is possible to see the fixing element 19 arranged on the slider 13 and the fixing element 20 on the switch 15*a*. In the damping stroke firstly the fixing element 19 on the slider 13 abuts the rigid fixing element 20 of the switch 15*a* (FIG. 5*a*), wherein in the deactivation position of the switch 15*a* the resilient fixing element 19 is movable beyond the rigid fixing element 20, in which case the resilient fixing element 19 is bendable against the force of its resilient action and the resilient fixing element 19 can be fixed relative to the rigid fixing element 20 due to a snapping back action (FIG. 5*c*). In FIG. 5*c* therefore the fixing element 19 arranged on the slider 13 is arrested so that the slider 13 cannot be extended again, for example by a return mechanism. The damping action of the damping device 9 is thus deactivated. By moving the switch 15*a* into an activation position the fixing element 19 is released again so that the slider 13 can be returned again.

Figure 6A:
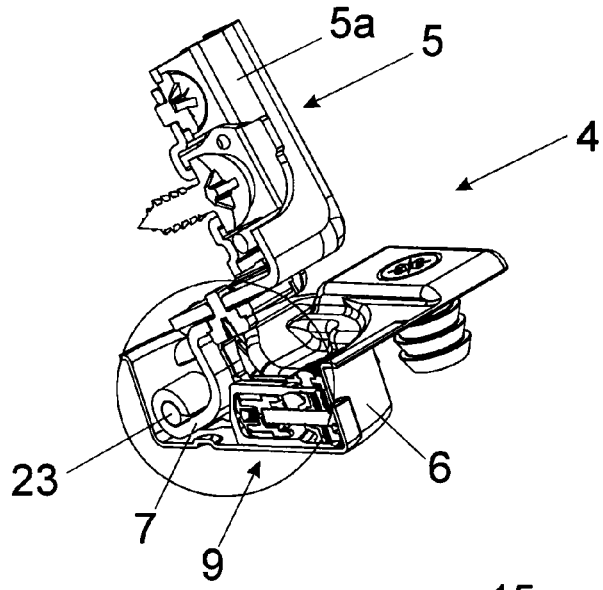
FIGS. 6*a* and 6*b* show a furniture hinge with a damping device integrated in the hinge cup and an enlarged detail view thereof.
Figure 6B:
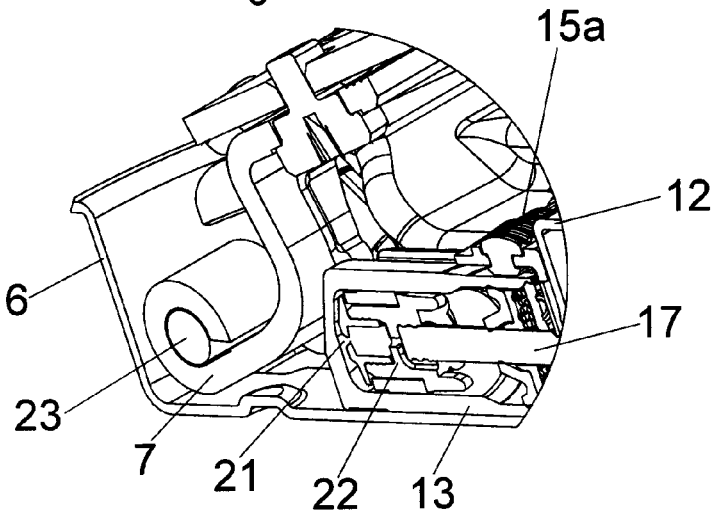

FIG. 6*a* shows a cross-section through a furniture hinge 4 with the damping device 9 in the mounting position. The furniture hinge 4 has a fitting member 5 which is in the form of a hinge arm 5*a*—and which is preferably L-shaped—and which is connected pivotably by way of a hinge lever 7 to a hinge cup 6. The hinge lever 7 is mounted pivotably about an axis of rotation 23 at the hinge cup side. FIG. 6*b* shows an enlarged detail view of the region circled in FIG. 6*a*. Towards the end of the closing movement the hinge lever 7 meets the inclined abutment surface 16 of the slider 13 and displaces it relative to the stationary piston 22. The damping stroke of the damping device 9 runs substantially at a right angle relative to the axis of rotation 23. The slider 13 can be arrested by the switch 15*a* in the pressed-in end position relative to the housing 12 of the damping device 9 whereby the damping action can be deactivated.

Figure 7:
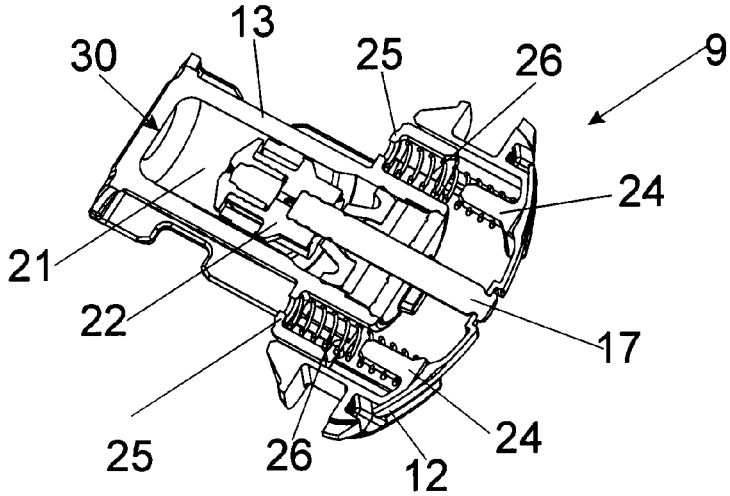
FIG. 7 shows a perspective sectional view of the damping device with a return mechanism.

FIG. 7 shows a longitudinal section of the damping device 9. The piston 22 with the piston rod 17 is mounted within the fluid chamber 21. It is possible to see a return mechanism 26 which is arranged outside the fluid chamber 21, in the form of two return springs which are supported on the one hand against abutments 24 of the housing 12 and on the other hand against counterpart abutments 25 of the slider 13. After the damping stroke has been performed the slider 13 can be returned again by the return mechanism 26 into a readiness position intended for the next damping stroke. It will be appreciated that it is also possible to arrange a return spring in the interior of the fluid chamber 21, which spring can be supported on the one hand against the end 30 of the fluid chamber 21 and on the other hand against the piston 22 thereby to push the piston 22 into the readiness position again.

The present invention is not limited to the illustrated embodiment but extends to all variants and technical equivalents which can fall within the scope of the accompanying claims. The positional references adopted in the description such as for example up, lateral and so forth are also related to the directly illustrated Figure and are to be appropriately transferred to the new position upon a change in position.

The invention claimed is:

1. A damping device for damping a movement of a movably mounted furniture part or a movably mounted furniture fitment component of a furniture fitment, the damping device comprising:

a piston arranged in a fluid chamber such that a damping action is produced by a relative movement between the fluid chamber and the piston and the piston assumes a pressed-in end position at an end of a damping stroke relative to the fluid chamber;

a slider in which the fluid chamber is accommodated;

a locking device having an arresting element, a first fixing element which is connected to the slider and which moves as a result of the damping stroke, and a second fixing element which is displaced by the arresting element, the locking device being configured such that actuating the arresting element releasably arrests a relative position between the fluid chamber and the piston in the pressed-in end position to deactivate the damping action, wherein actuation of the arresting element displaces the second fixing element between a first position in which the damping action is activated and a second position in which the damping action is deactivated, wherein the second fixing element engages the first fixing element in the second position to arrest the relative position between the fluid chamber and the piston, and wherein the second fixing element is configured such that a direction of the displacement between the first position and the second position is transverse to a direction of the damping stroke.

2. A furniture hinge comprising:

a carcass-side fitting member;

a hinge cup hingedly connected to the carcass-side fitting member; and the damping device of claim 1, wherein the damping device is configured to be detachably connected within the hinge cup, and wherein the damping device dampens a movement of the carcass-side fitting member relative to the hinge cup when the damping action is activated by the locking device, and the damping device is configured such that the carcass-side fitting member moves relative to the hinge cup without damping action when the damping action is deactivated by the locking device.

3. The furniture hinge of claim 2, wherein the hinge cup and the damping device are detachably connected to each other by a securing projection which engages a securing groove as the damping device is inserted from above into the hinge cup.

4. The furniture hinge of claim 2, wherein the damping device is disposed completely within the hinge cup.

5. The furniture hinge of claim 2, wherein the damping device is disposed substantially completely within the hinge cup.

6. The furniture hinge of claim 2, further comprising a return mechanism, wherein the slider and the locking device are configured such that the first fixing element is displaceable beyond the second fixing element in the second switch position of the locking device, and wherein the return mechanism holds the first fixing element against the second fixing element in the second switch position of the locking device in a manner such that the first fixing element bends against a force of its own resiliency.

7. The damping device of claim 1, wherein the piston is stationary in a mounting position and the fluid chamber is displaceable relative to the piston.

8. The damping device of claim 1, further comprising a return mechanism by which the piston is movable into an extended end position relative to the fluid chamber.

9. The damping device of claim 1, further comprising a return mechanism having a return spring by which the piston is movable into an extended end position relative to the fluid chamber.

10. A damping device for damping a movement of a movably mounted furniture part or a movably mounted furniture fitment component of a furniture fitment, the damping device comprising:

a piston arranged in a fluid chamber such that a damping action is produced by a relative movement between the fluid chamber and the piston and the piston assumes a pressed-in end position at an end of a damping stroke relative to the fluid chamber; and a locking device having an arresting element, a first fixing element which moves as a result of the damping stroke, and a second fixing element which is displaced by the arresting element, the locking device being configured such that actuating the arresting element releasably arrests a relative position between the fluid chamber and the piston in the pressed-in end position to deactivate the damping action, wherein actuation of the arresting element displaces the second fixing element between a first position in which the damping action is activated and a second position in which the damping action is deactivated, wherein the second fixing element engages the first fixing element in the second position to arrest the relative position between the fluid chamber and the piston, wherein the second fixing element is configured such that a direction of the displacement between the first position and the second position is transverse to a direction of the damping stroke, wherein the first and second fixing elements are configured such that displacing the second fixing element to the second position and thereafter moving the piston or the fluid chamber to the end of the damping stroke causes one of the first and second fixing elements to resiliently deform until the second fixing element engages the first fixing element and arrests the relative position between the fluid chamber and the piston in the pressed-in end position.

11. The damping device of claim 10, wherein the one of the first and second fixing elements which resiliently deforms allows the first fixing element to pass over the second fixing element to reach an engaged position which arrests the relative position between the fluid chamber and the piston in the pressed-in end position.

12. A furniture hinge comprising:

a carcass-side fitting member;

a hinge cup hingedly connected to the carcass-side fitting member; and the damping device of claim 11, wherein the damping device is configured to be detachably connected within the hinge cup, and wherein the damping device dampens a movement of the carcass-side fitting member relative to the hinge cup when the damping action is activated by the locking device, and the damping device is configured such that the carcass-side fitting member moves relative to the hinge cup without damping action when the damping action is deactivated by the locking device.

13. The furniture hinge of claim 12, wherein the hinge cup and the damping device are detachably connected to each other by a securing projection which engages a securing groove as the damping device is inserted from above into the hinge cup.

14. The furniture hinge of claim 12, wherein the damping device is disposed completely within the hinge cup.

15. The furniture hinge of claim 12, wherein the damping device is disposed substantially completely within the hinge cup.

16. The furniture hinge of claim 12, further comprising a return mechanism, wherein the locking device is configured such that the first fixing element is displaceable beyond the second fixing element in the second switch position of the locking device, and wherein the return mechanism holds the first fixing element against the second fixing element in the second switch position of the locking device in a manner such that the first fixing element bends against a force of its own resiliency.

17. The damping device of claim 10, wherein the piston is stationary in a mounting position and the fluid chamber is displaceable relative to the piston.

18. The damping device of claim 10, further comprising a return mechanism by which the piston is movable into an extended end position relative to the fluid chamber.

19. A furniture hinge comprising:

a carcass-side fitting member;

a hinge cup hingedly connected to the carcass-side fitting member; and a damping device for damping a movement of the fitting member relative to the hinge cup, the damping device including (i) a piston arranged in a fluid chamber such that a damping action is produced by a relative movement between the fluid chamber and the piston and the piston assumes a pressed-in end position at an end of a damping stroke relative to the fluid chamber;

(ii) a locking device having an arresting element, a first fixing element which moves as a result of the damping stroke, and a second fixing element which is displaced by the arresting element, the locking device being configured such that actuating the arresting element releasably arrests a relative position between the fluid chamber and the piston in the pressed-in end position to deactivate the damping action; and (iii) a housing on which the locking device, the piston, and the fluid chamber are mounted, wherein actuation of the arresting element displaces the second fixing element between a first position in which the damping action is activated and a second position in which the damping action is deactivated, wherein the second fixing element engages the first fixing element in the second position to arrest the relative position between the fluid chamber and the piston, wherein the second fixing element is configured such that a direction of the displacement between the first position and the second position is transverse to a direction of the damping stroke, and wherein the damping device is configured to be detachably connected within the hinge cup with an upper surface of the housing facing away from a bottom of the hinge cup, wherein the damping device dampens a movement of the carcass-side fitting member relative to the hinge cup when the damping action is activated by the locking device, and the damping device is configured such that the carcass-side fitting member moves relative to the hinge cup without damping action when the damping action is deactivated by the locking device, and wherein the arresting element of the locking device is disposed on the upper surface of the housing such that the arresting element can be actuated while the damping device is disposed in the hinge cup.

20. The furniture hinge of claim 19, wherein the hinge cup and the damping device are detachably connected to each other by a securing projection which engages a securing groove as the damping device is inserted from above into the hinge cup.

* * * * *